US006910678B2

(12) United States Patent
Small

(10) Patent No.: US 6,910,678 B2
(45) Date of Patent: Jun. 28, 2005

(54) BRACKET FOR SUPPORTING BANNERS ON BUILDINGS

(76) Inventor: Mark L. Small, 850 Chicago Rd., Troy, MI (US) 48083

( * ) Notice: Subject to any disclaimer, the term of this patent is extended or adjusted under 35 U.S.C. 154(b) by 0 days.

(21) Appl. No.: 10/664,282

(22) Filed: Sep. 17, 2003

(65) Prior Publication Data

US 2005/0056820 A1 Mar. 17, 2005

(51) Int. Cl.[7] ..... B66D 1/36
(52) U.S. Cl. ..... 254/334
(58) Field of Search ..... 254/329, 334, 254/342

(56) References Cited

U.S. PATENT DOCUMENTS 927,200 A * 7/1909 Wick ..... 254/342
3,948,488 A * 4/1976 Brockelsby ..... 254/323
5,064,079 A * 11/1991 Bowerman ..... 212/345
5,871,188 A * 2/1999 Lyle ..... 248/223.41
6,059,266 A * 5/2000 Ascherin et al. ..... 254/334

* cited by examiner

*Primary Examiner*—Emmanuel Marcelo
(74) *Attorney, Agent, or Firm*—Gifford, Krass, Groh, Sprinkle, Anderson & Citkowski P.C.

(57) ABSTRACT

A fixture for suspending banners, signs and the like on the sides of multistory buildings, includes a U-shaped bracket adapted to engage the sides and end of a vertical parapet or a horizontal overhang. The fixture supports a powered winch over which cables connected to the banner or the like are arranged so as to allow the raising and lowering of the banner by powering the winch. Clamps on the U-shaped brackets securely retain the fixture in position on the building.

4 Claims, 3 Drawing Sheets

BRACKET FOR SUPPORTING BANNERS ON BUILDINGS

FIELD OF THE INVENTION

This invention relates to fixtures for raising, lowering, and supporting banners and the like along the sides of buildings and more particularly to such a fixture adapted to be engaged with a parapet or overhang at the top of the building including a powered winch for engaging ropes or cables connected to the banner.

BACKGROUND OF THE INVENTION

It is often desirable to array banners, signs, flags and the like (hereinafter collectively referred to as "banners") along the sides of the building with the banners (hereinafter collectively referred to as "banners") being supported vertically, in contact with or closely adjacent to the building. Often, these banners are supported by ropes, wires or cables (hereinafter "cables") attached at the top edge of the two horizontal end points of the banner and at possibly one or more intermediate points. The banners have heretofore been carried to the roofs of the buildings and then manually lowered to a desired position. The free ends of the cables are then secured to any available structure in the building roof.

This arrangement requires extensive time and manpower to properly locate the banners along the building sides and also presents safety problems because of the ad hoc method of securing the cable ends to building structures.

SUMMARY OF THE INVENTION

The present invention is directed to mechanism which allows banners to be deployed on building sides in an easily adjustable and secure manner without creating any safety problems.

A preferred embodiment of the invention which will subsequently be described in detail, comprises a U-shaped bracket having a pair of spaced parallel legs joined by a planar bight. The legs are spaced so that the bracket may be slipped over the end of a vertical parapet extending above the roof of the building or a horizontal overhang from the top of the building. Screw adjustable clamp members affixed to the legs allow the bracket to be securely retained to parapet or overhang. The bracket supports a motor driven winch carrying a cable which can be attached to the upper edge of the bracket.

A plurality of these fixtures are arrayed at spaced points along the parapet or overhang, with the two extreme fixtures spaced by the width of the bracket.

The motors which power the winches may be energized by remote control units which may be carried by personnel on the ground so that they may visually observe proper alignment of the bracket. The remote control units may either be wirelessly connected to the winches or connected through elongated cables.

One embodiment of the invention employs lamps on the bracket adapted to project light downwardly onto the banner so as to illuminate it.

Other objects, advantages and applications of the present invention will be made apparent by the following detailed description of two embodiments of the invention.

BRIEF DESCRIPTION OF THE DRAWING

Referring to FIG. 1, a building, general indicated at 10, has a flat roof 12 surrounded at its perimeter by a parapet 14 which extends above the roof. The building 10 may be a multi-story building or a relatively tall single story building. It is illustrated as having a central entrance 16 and windows 18.

Figure 1:
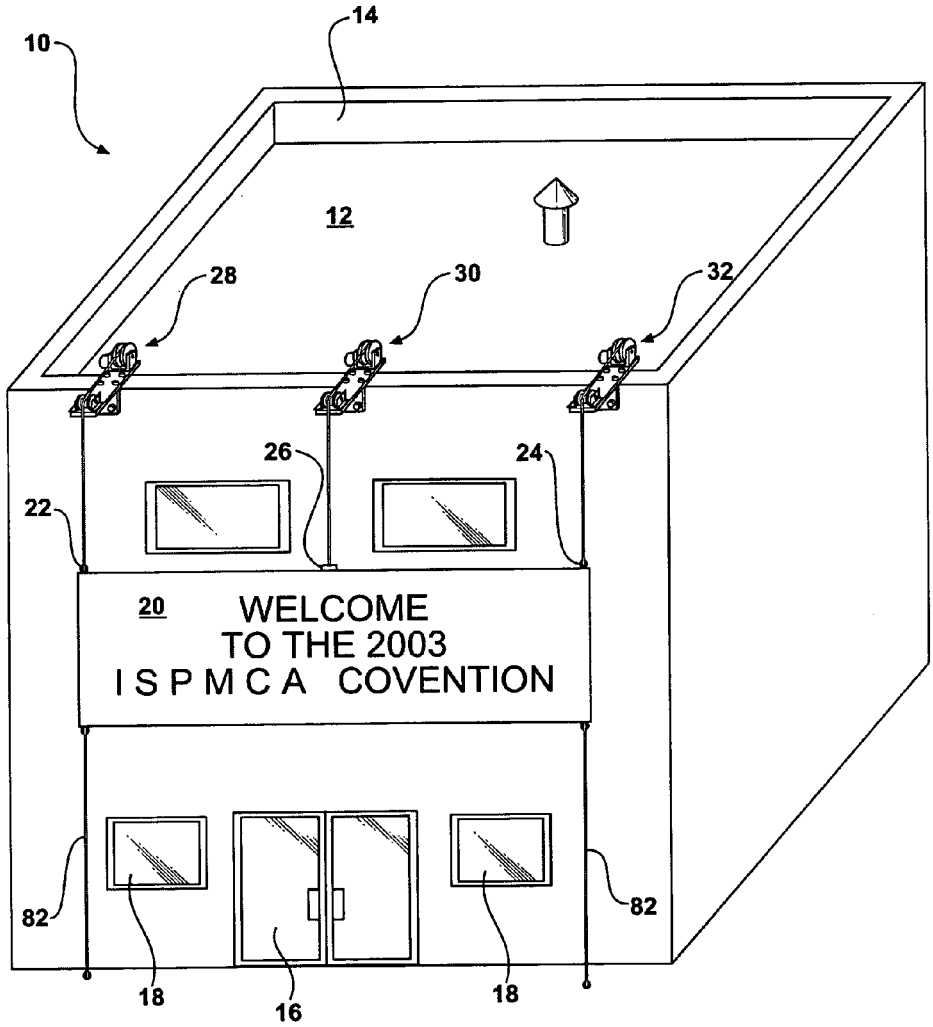
FIG. 1 is a perspective view of the front of a multi-story building having a vertical parapet on the roof, employing four fixtures formed in accordance with preferred embodiment of the invention for raising, lowering and supporting a banner on the building side.

The function of the apparatus of the present invention is to array and support a banner, sign, flag or the like 20 on a side wall of the building beneath the parapet 14. The embodiment of the banner 20 illustrated in FIG. 1 is rectangular and has three cable attachment points along its upper edge, two at the corners 22 and 24, and one at the center 26. The number of cable attachments points provided is a variable, depending upon the width and weight of the sign.

Figure 2:
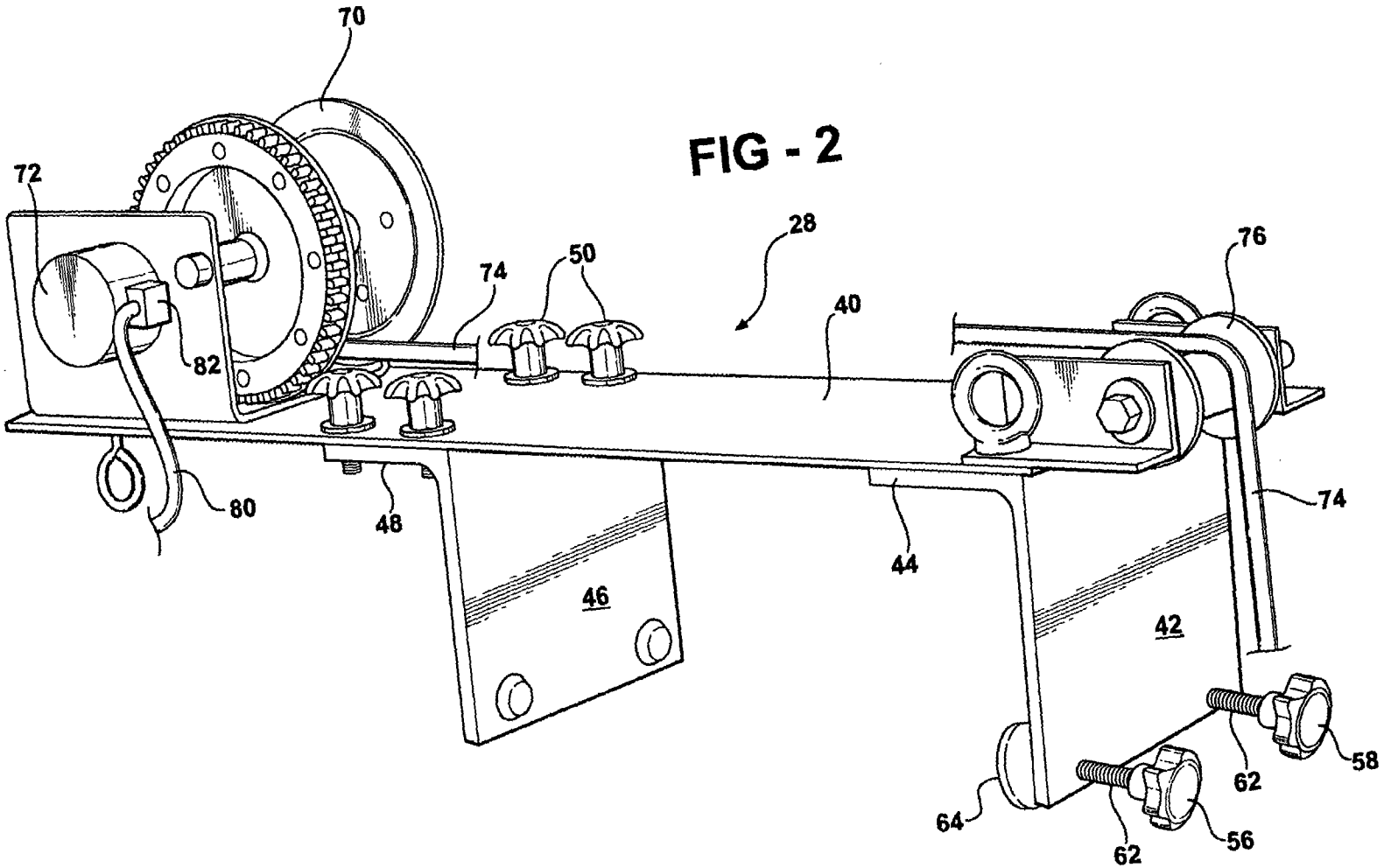
FIG. 2 is a perspective view of first embodiment of my invention adapted to be retained on a building parapet.

These cables are secured by three substantially identical devices, 28, 30 and 32 which are spaced on one side of the parapet 14 at the same spacing as the three cable attachment points 22, 26 and 24. As illustrated in FIG. 2, the preferred embodiment of the invention employs an elongated rectangular plate 40 may be formed of steel, aluminum, a suitable plastic or other rigid material. A first normally extending leg 42 which may be welded, bolted or otherwise secured to the plate 40 via an L-shaped leg 44. A second normally extending leg 46 is attached to the plate 40 in spaced relationship to the plate 42 so that the two legs and the intermediate section of the plate 40 form a u-shaped section which may engage the parapet 14 of a building. The leg 46 has an L-shaped section 48 which is preferably secured to the plate 40 by bolts 50. This allows the spacing of legs 42 and 46 to be modified to accommodate different parapet widths. The section of the plate 40 intermediate the legs 42 and 46 acts as a bight for the U-shaped plate.

Clamp members 56 and 58 include central screw sections 60 and 62 respectively which pass through threaded holes in the lower end of the leg 42 and carry clamping pads 64 on their interior sides. Similar clamps may be secured to the leg 46. These clamps are used to retain the structure 28 on the sidewalls of the parapet with the plate 40 overlying the top of the parapet.

An extension of the plate 40 beyond the leg 46 supports a winch 70 which may be driven by a motor 72. A cable 74 is arrayed over the winch and passes over a roller 76 secured to the plate 40 above the leg 42 so that the cable may pass over the forward surface of the leg 42. The far end of the cable 24 preferably includes a clamp (not shown) for securing to the top of the banner 22. The drive motor 72 for the winch 70 is electrically powered through a cable 80 and a control box 82. The control box includes switching means for energizing and de-energizing the motor. In a preferred embodiment the switching means is wirelessly controlled from a remote control that may be used by ground personal. In other embodiments, a wired connection could be used.

After the desired number of devices such as 28 are attached to the parapet, the cable ends are connected to the top of the banner 20 and the respective drive motors 72 are controlled to lift and position the banner on the building side. Ropes or cables 82 may be secured to the lower edges of the banner and affixed to appropriate ground supports so that the banner may be drawn closely against the building side.

Figure 3:
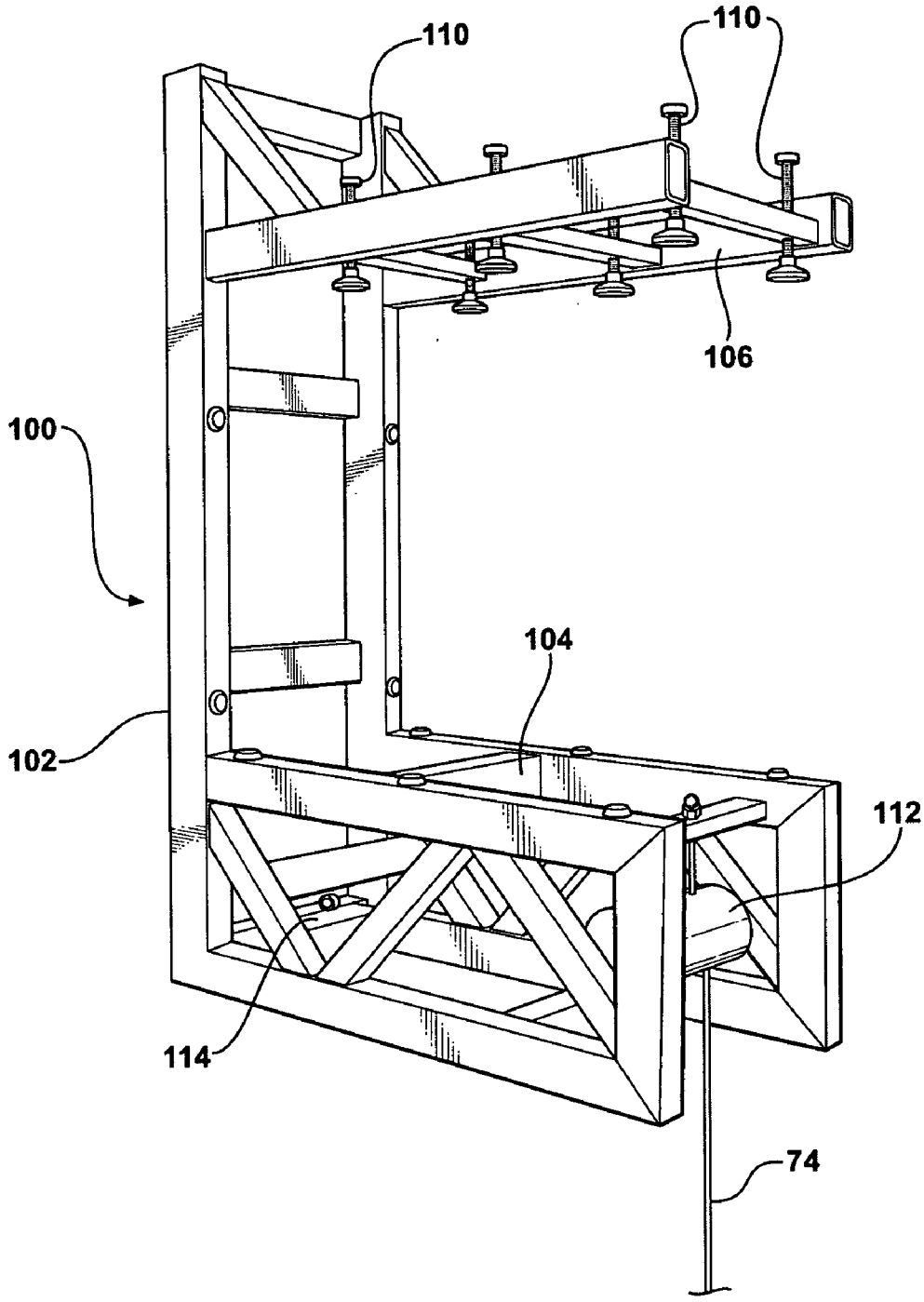
FIG. 3 is a perspective view of a second embodiment to the invention adapted to be supported on a horizontal roof overhang.

FIG. 3 illustrates a second embodiment of the invention, generally indicated at 100, for use with buildings having horizontal roof overhangs extending beyond the edges of the building. The embodiment employs a frame member 102 preferably fabricated by welding a plurality of metal beams and adapted to be supported in a vertical position over the far end of the overhang. The frame includes a pair of spaced legs 104 and 106 which extend normally to the frame 102 so that the section of the frame member between the legs 104 and 106 acts as a bight of a U-shaped clamp. Adjustable clamping members 110 are threaded through the upper leg 106 to secure the frame 100 over the building overhang. A motor driven winch 112 with an appropriate control box (not shown) is secured beneath the leg 104. A cable 74 may be arrayed over the winch. The frame may also support lamps 114 which, when energized from the same power source powers as the winch 112 project light onto the banner supported on the side of the building below the overhang.

Having thus described my invention, I claim:

1. A fixture for raising, lowering, and supporting a banner on the side of a multi-story or tall single storied building, comprising:

a U-shaped bracket having a pair of generally planar, parallel, legs joined by a generally planar bight adapted to engage a vertical parapet or horizontal overhang at the top of the building;

adjustable clamp members adapted to retain the bracket on the building;

a motor driven winch supported on the bracket and adapted to engage the end of a cable attached to the banner so that upon powering of the winch the banner is raised or lowered as cable is arranged and is reeled from the winch; and a remote control member for the winch motor.

2. The fixture of claim 1 in which the remote control is wirelessly connected to the winch motor.

3. The fixture of claim 1 in which the remote control is wired to the winch motor.

4. The fixture of claim 1 further including electric lamps supported on the bracket in the direction of the banner so as to illuminate the banner supported by the bracket.

* * * * *